United States Patent [19]

Santo

[11] Patent Number: 4,869,939

[45] Date of Patent: Sep. 26, 1989

[54] INTERACTIVE, AIR ENCAPSULATING CELLULAR MATERIAL

[76] Inventor: Philip J. Santo, 12 Mountain Rd., Rochester, N.Y. 14625

[21] Appl. No.: 158,641

[22] Filed: Feb. 19, 1988

[51] Int. Cl.[4] ..... B27N 5/02

[52] U.S. Cl. ..... 428/35.2; 206/594; 383/38; 428/178

[58] Field of Search ..... 428/178, 35, 35.2; 206/594; 383/38

[56] References Cited

U.S. PATENT DOCUMENTS 3,746,605 7/1973 Dillon et al. ..... 206/594

3,769,145 10/1973 Gresham et al. ..... 206/594

4,433,783 2/1984 Dickinson ..... 383/38

*Primary Examiner*—Ellis P. Robinson

*Assistant Examiner*—P. J. Ryan

*Attorney, Agent, or Firm*—Lawrence P. Kessler

[57] ABSTRACT

Air encapsulating cellular material in which failure due to the rupture of individual ones of the cells thereof is substantially prevented. The material comprises a sheet defining a plurality of air encapsulating cells in a substantially uniform pattern. At least a pair of adjacent cells are in flow communication so that upon direct pressure to one of such cells, the air may be displaced and can flow to the adjacent cell. In this manner, air pressure build up in one cell which may otherwise have resulted in its rupture, is prevented.

4 Claims, 1 Drawing Sheet

INTERACTIVE, AIR ENCAPSULATING CELLULAR MATERIAL

RELATED APPLICATIONS

This application is related to my copending U.S. patent application Ser. No. 158,642, entitled DEVICE FOR REDUCING WAVE MOTION IN A WATERBED MATTRESS, and Ser. No. 158,639 entitled BOUYANT INSERT FOR A WATERBED MATTRESS, filed on even date herewith.

BACKGROUND OF THE INVENTION

This invention relates in general to air encapsulating cellular material, and more particularly to air encapsulating cellular material in which certain of the cells of such material are interactively coupled together.

Air encapsulating cellular material has recently become popular for packaging fragile articles. Such material includes a sheet which is flexible and substantially impervious to air. A plurality of cells are formed in the material, and such cells are filled with air under pressure. When the material is wrapped around a fragile article, the air pressure in the cells can absorb shock to the article and prevent damage thereto. However, load on an individual one of the cells may cause the pressure within such cell to exceed the ability of the cell material to withstand such pressure. That cell may then rupture, thereby eliminating it as an effective means of protecting the article. In general, the rupture of one cell, or a minor number of cells, does not present a problem, as the remainder of the cells can still perform the desired protective function. There is, of course, a limit to the number of cells which can rupture without substantially reducing the effectiveness of the material in preventing article damage. This number is directly related to the particular application of the material.

Air encapsulated cellular material can also be used in other applications, such as for padding of carpeting or as a bouyant insert for a waterbed mattress such as shown and described in my aforementioned copending U.S. patent applicaton Ser. Nos. 158,642, and 158,639. In such other uses, rupture of even a minor number of the cells may be extremely detrimental.

SUMMARY OF THE INVENTION

This invention is directed to air encapsulating cellular material in which failure due to the rupture of individual ones of the cells thereof is substantially prevented. The material comprises a sheet defining a plurality of air encapsulating cells in a substantially uniform pattern. At least a pair of adjacent cells are in flow communication so that upon direct pressure to one of such cells, the air may be displaced and can flow via the intercommunication to the adjacent cell. In this manner, air pressure build up in one cell, which may otherwise have resulted in its rupture, is prevented.

The invention, and its objects and advantages, will become more apparent in the detailed description of the preferred embodiments presented below.

BRIEF DESCRIPTION OF THE DRAWINGS

In the detailed description of the preferred embodiments of the invention presented below, reference is made to the accompanying drawings, in which.

DESCRIPTION OF THE PREFERRED EMBODIMENTS

Figure 1:
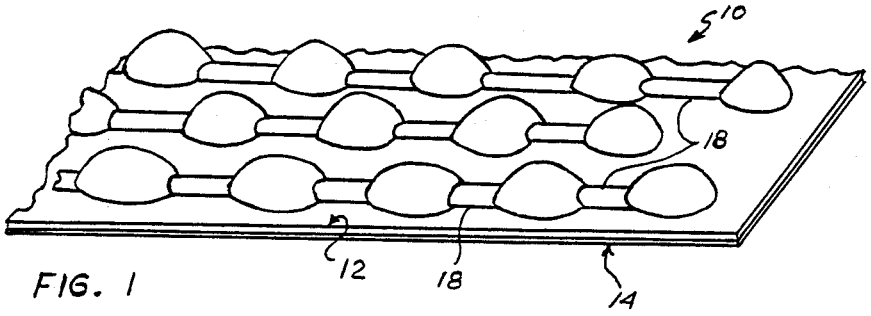
FIG. 1 is a view, in perspective, of a portion of a sheet of air encapsulating cellular material according to this invention.
Figure 2:
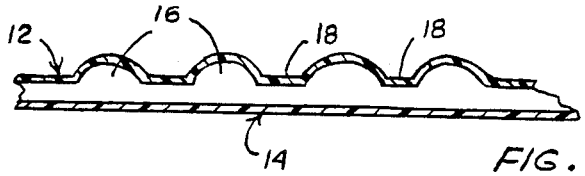
FIG. 2 is a side elevational view, in cross-section, of a portion of the sheet of air encapsulating cellular material according to this invention.

Referring now to the accompanying drawings, FIGS. 1 and 2 show a portion of air encapsulating cellular material, designated generally by the numeral 10, according to this invention. The air encapsulating cellular material 10 includes a first sheet 12 and a second sheet 14 of flexible, substantially air impervious material, such as polyvinylchloride or polyvinylethtylene for example. The sheets 12 and 14 are joined together to form a plurality of air encapsulating cells 16 aligned in a substantially uniform pattern, such as rows for example. Of course, it is suitable for use with this invention if an additional sheet layer, such as nylon for example, is inserted between the sheets of the cellular material to give added strength to such material.

According to this invention, the cells 16 of the air encapsulating cellular material 10 are made interactive by passages 18 extending between adjacent cells. The passages 18 are formed by the sheet 12, and open at each end into adjacent cells to provide flow communication between such adjacent cells. In the embodiment of FIGS. 1 and 2, the passages 18 interconnect all the cells in a particular row.

By this construction, external pressure exerted on one cell in the row causes the air within such cell to flow into adjacent cells. This results in a distribution of the increased air pressure caused by the external pressure over adjacent cells. Such distribution of the increased air pressure prevents any particular cell from becoming pressurized to the extent that the wall of such cell will rupture. The overall result is that the material 10 maintains its effective purpose, without losing cells due to rupture thereof as is the case with prior art encapsulating material.

Figure 3:
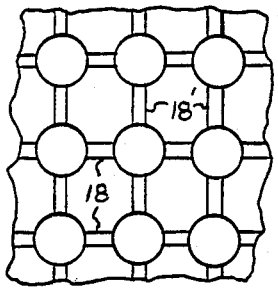
FIG. 3 is a top plan view of an alternate embodiment of the air encapsulating cellular material according to this invention.
Figure 4:
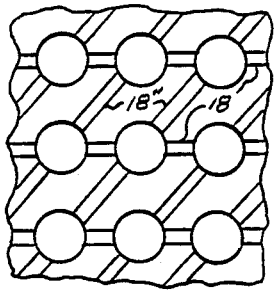
FIG. 4 is a top plan view of another alternate embodiment of the air encapsulating cellular material according to this invention.

In the alternate embodiments of the air encapsulating material according to this invention shown in FIGS. 3 and 4, the respective passages 18' and 18'' serve to interconnect cells of adjacent rows. The interconnection of adjacent rows yields the same effect of distribution of increased air pressure as described with the embodiment of FIGS. 1 and 2. Accordingly, these alternate embodiments also prevent the rupture of individual cells under direct loading. It is of course within the scope of this invention that other suitable patterns of interconnecting cells may be provided for the interactive air encapsulating material thereof. It is also comprehended that with intercommunicating cells for the air encapsulating material, it is possible to provide a mechanism such as a valve V for example at the end of a row of intercommunicating cells, to readily selectively inflate or deflate such cells. In this manner the cells can be deflated for packaging the material, and inflated to enable the material to perform in its intended manner.

The invention has been described in detail with particular reference to a preferred embodiments thereof, but it will be understood that variations and modifications can be effected within the spirit and scope of the invention.

I claim:

1. Interactive air encapsulating cellular material comprising:

first and second sheets of flexible, substantially air impervious material, said first and second sheets being joined together in a pattern to form a plurality of air encapsulating cells in a substantially uniform pattern;

a plurality of chambers defined by said first and second sheets, said chambers extending between adjacent cells respectively and open at each end thereof into said cells for establishing an air flow passage between at least a pair of adjacent cells so that air may be displaced from one of such cells to the other in order to prevent rupture of such one cell; and means associated with at least one cell of adjacent cells connected by said chambers for selectively enabling said cells to be inflated and deflated.

2. The invention of claim 1 wherein said air encapsulating cells are aligned in substantially parallel rows.

3. The invention of claim 1 wherein said chamber interconnects substantially all cells in a row.

4. The invention of claim 1 wherein said chamber interconnects cells in adjacent rows.

* * * * *